United States Patent [19]

Patenaude et al.

[11] 4,295,410

[45] Oct. 20, 1981

[54] GUN BOLT LOCKING SYSTEM

[75] Inventors: Raymond A. Patenaude, Burlington; Steven R. Duke, Williston; Edward A. Proulx, Burlington, all of Vt.

[73] Assignee: General Electric Company, Burlington, Vt.

[21] Appl. No.: 97,993

[22] Filed: Nov. 28, 1979

[51] Int. Cl.[3] ..... F41D 7/04

[52] U.S. Cl. ..... 89/12; 89/176

[58] Field of Search ..... 89/168, 176, 190, 12

[56] References Cited

U.S. PATENT DOCUMENTS 1,786,207 12/1930 Hudson .

2,962,936 12/1960 Lippert et al. ..... 89/199

3,608,427 9/1971 Colby ..... 89/176

3,834,272 9/1974 Patenaude et al. ..... 89/12

4,114,511 9/1978 Patenaude ..... 89/33 CA

OTHER PUBLICATIONS

George M. Chinn, The Machine Gun, 1955, vol. IV, parts X and XI, pp. 384, 371, 355.

*Primary Examiner*—Stephen C. Bentley

*Attorney, Agent, or Firm*—Bailin L. Kuch

[57] ABSTRACT

A feature of this invention is the provision of a slider coupled to the gun bolt for camming the locking lugs and for positively retaining the lugs in their bolt-locking disposition.

12 Claims, 8 Drawing Figures

GUN BOLT LOCKING SYSTEM

The U.S. Government has rights in this invention pursuant to Contract No. F08635-77-C-0173 awarded by the U.S. Air Force.

BACKGROUND OF THE INVENTION

1. Field of the Invention

This invention relates to mechanisms for locking the gun bolts in automatic guns, such as Gatling type guns, and, more particularly, to such mechanisms utilizing cammed locking lugs.

2. Description of the Prior Art

The use of cammed locking lugs to lock gun bolts to gun barrels is well known, and is shown, for example, in "The Machine Gun" by G. M. Chinn, Vol. IV, Parts X and XI, pp. 371, 384, 385, Dept. of the Navy, 1955. Therein are shown for example: "Figure 6-76—Locking Rollers Are Cammed Free of Barrel Extension by Rails in Receiver." "Figure 6-89 [and 6-90]—Recoiling Barrel Extension Cams Lugs Free of Bolt." In U.S. Pat. No. 3,608,427 issued Sept. 28, 1971 to R. H. Colby, there is shown a gun bolt which is locked by lugs which are nested in pockets in the recoiling gun barrel extension and which are swung out to lock the gun bolt by cam followers which ride in a stationary cam track.

BRIEF DESCRIPTION OF THE INVENTION

It is an object of this invention to provide an improved locking system for an automatic gun.

It is a more particular object to provide a cammed locking lug system for the gun bolts in guns having a rotating barrel cluster which is free from the possibility of unintentional bounce and unlock.

A feature of this invention is the provision of a slide coupled to the gun bolt for camming the locking lugs and for positively retaining the lugs in their bolt-locking disposition.

BRIEF DESCRIPTION OF THE DRAWING

These and other objects, features and advantages of the invention will be apparent from the following specification thereof taken in conjunction with the accompanying drawing in which.

DESCRIPTION OF THE INVENTION

This invention is incorporated in a gun bolt of the type shown in Ser. No. 002,037 filed Jan. 8, 1979, which in turn is incorporated in a gun of the small diameter rotor type shown in U.S. Pat. No. 3,834,272 issued Sept. 10, 1974 to R. A. Patenaude et al and U.S. Pat. No. 4,114,511 issued Sept. 19, 1978 to R. A. Patenaude. Of course, the invention has utility in other gun bolts in other guns.

Figure 2:
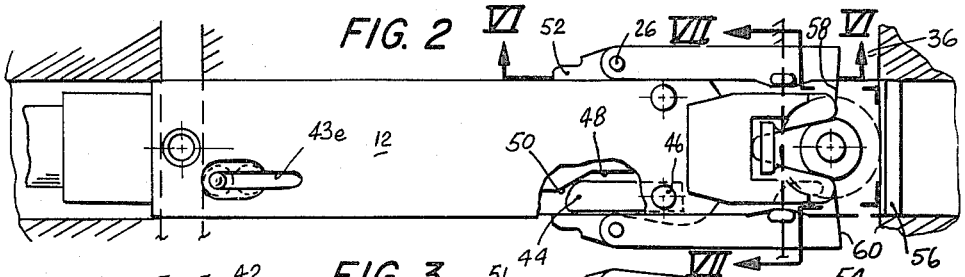
FIG. 2 is a top view of the gun bolt of FIG. 1 showing the gun bolt unlocked.
Figure 3:
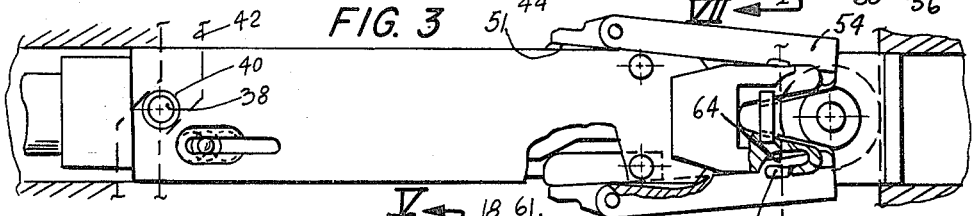
FIG. 3 is similar to FIG. 2 but showing the gun bolt partially locked.
Figure 4:
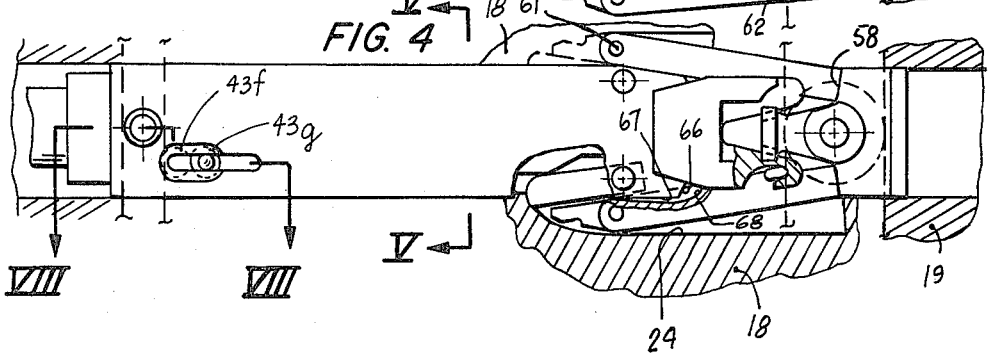
FIG. 4 is similar to FIG. 3 but showing the gun bolt fully locked.
Figure 1:
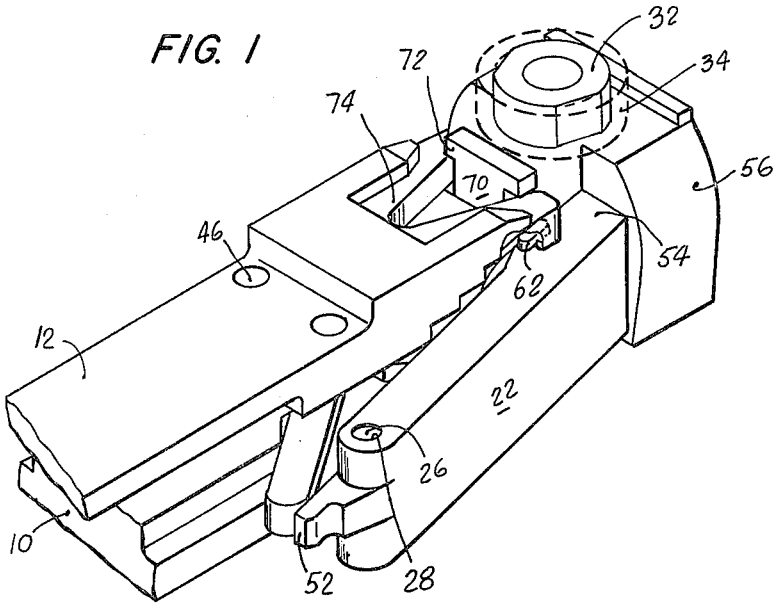
FIG. 1 is a perspective view of a portion of a gun bolt of the type shown in U.S. Ser. No. 002,037, filed Jan. 8, 1979, by R. A. Patenaude et al, which is improved by the incorporation of an embodiment of this invention.
Figure 7:
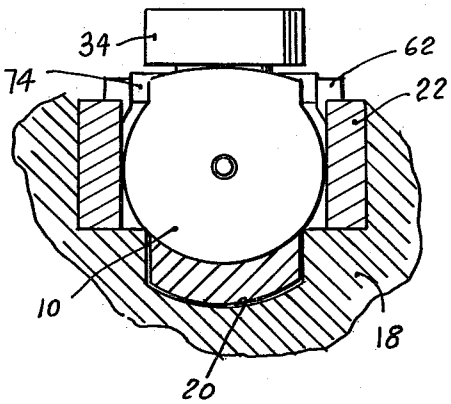
FIG. 7 is a partial detail view in transverse cross-section showing the gun bolt journaled in the rotor.
Figure 8:
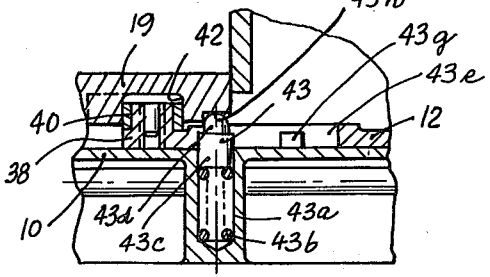
FIG. 8 is a partial detail view in longitudinal cross-section showing the cam follower and detent mechanism of the locking slide.
Figure 6:
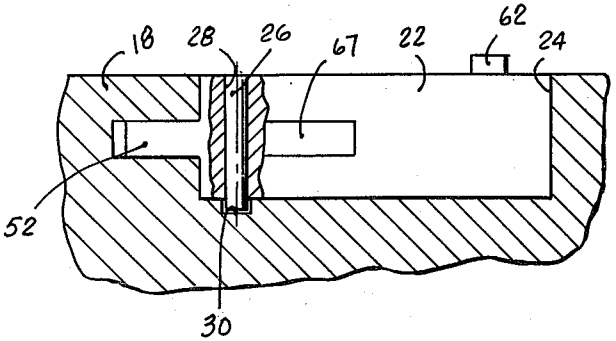
FIG. 6 is a partial detail view in longitudinal cross-section showing the wing lock in elevation as nested in the pocket in the rotor.
Figure 5:
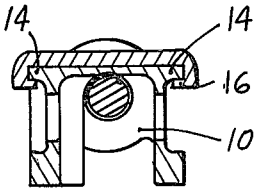
FIG. 5 is a partial detail view in transverse cross-section showing the locking slide captured to the body of the gun bolt.

The gun bolt embodying this invention as shown in FIG. 1 includes a bolt body 10 and a slide 12. As shown in FIG. 6, the body has, in part, a T-shaped cross-section wherein the ends of the "T" provide rails 14 and the slide has a pair of depending and inward-going sides 16 encircling the rails to capture the slide to the body while permitting longitudinal relative motion. There are a plurality of gun bolts, e.g., three, one for each gun barrel. The gun barrels are fixed to the rotor 18 which is journaled for rotation in a housing 19, and each gun bolt is journaled for longitudinal reciprocation in a respective channel 20 in the rotor, as shown in FIG. 7. As is well known, the rotor in a Gatling type gun serves as a receiver.

Each of a symmetric pair of locking lugs 22 is nested in a respective recess 24 in the rotor 18 adjacent the channel 20. A pin 26, which passes through a bore 28 in the lug 22 into a blind bore 30 in the rotor, pivotally captures the lug in the rotor.

Each gun bolt body 10 has a stud 32 fixed thereto on which is journaled a cam follower roller 34 which rides in a cam track 36 formed in the interior wall of the housing 19, and which cam track serves to reciprocate the bolt fore and aft as the rotor revolves about its longitudinal axis. The rotor may be driven by appropriate means, such as an external drive, as shown in U.S. 3,834,272, supra. Each slide 12 has a stud 38 fixed thereto on which is journaled a cam follower roller 40 which rides in a cam track 42 formed in the interior wall of the housing, and which cam track serves to reciprocate the slide relative to its respective gun bolt, as the assembly of the gun bolt and the slide reciprocates relative to the rotor. The cam track 42 is not continuous, but rather, is provided only where necessary to provide relative movement between the slide and the bolt body. A detent mechanism is provided to hold the slide and the bolt body against relative movement. A plunger 43 is disposed in a blind bore **43*a* and is biased outwardly by a helical compression spring 43*b*. The plunger has a main body portion 43*c* of relatively large diameter and a cam follower portion 43*d* of relative smaller diameter. The follower portion clears and passes through a slot 43*e* in the slide. The body portion 43*c* will seat in either of two cups 43*f* or 43*g* in the slot, and when so seated, locks the slide to the bolt body. The plunger is withdrawn from either cup by means of a cam surface 43*h*** depressing the follower against the bias of the spring.

Each of a symmetric pair of actuator lugs 44 is pivotally captured to the slide 12 by a respective pin 46 and nested within a respective recess 48 into the side of the gun bolt body 10. Each recess 48 has a respective ramp surface 50, which serves to cam the distal end of the lug 44 outwardly when the slide 12 is moved aft relative to the gun bolt body 10. As the distal end of the lug 44 moves outwardly it abuts a cam following surface 51 of the aft end 52 of the adjacent locking lug 22 which is journaled on pivot 26 in the rotor and swings said aft end 52 outwardly and, thereby, the forward end 54 of the locking lug inwardly. As the forward end 54 swings inwardly, it enters a recess in the bolt body aft of the head 56 of the bolt. This recess has an aft facing surface 58 which receives the forward facing end surface 60 of the locking lug. Thus pressure against the face of the head 56 of the bolt body 10 is transmitted across the surfaces 58 and 60, through the locking lugs 22, to an arcuate surface 61 of the rotor 18.

Each of the pair of locking lugs 22 also has a respective stud 62 fixed to the forward end. The forward end of the slide 12 has a pair of somewhat arcuate slots 64 cut into its underface. As the slide 12 progressively moves aft, the lugs 44 progressively swing out, the lug aft ends 52 progressively move in, and the lug forward ends 54 progressively move in and the lugs 62 progressively enter into the respective arcuate slots 64. When the slide 12 is fully aft, the lugs 62 are fully into the blind forward ends of the slots, so that the slide precludes any pivotal movement of the locking lug.

Thus the slide 12 which is controlled by its cam follower 40 in the cam track 42, not only drives the locking lugs into their bolt locking configuration by means of the ramp surfaces 50 and the actuator lugs 44, but also captures the locking lugs in their bolt locking configuration by means of the arcuate slots 64, so that any possibility of unlocking movement of the locking lugs at the time of firing is precluded.

The slide also has a symmetric pair of shoulders with respective ramp surfaces 66, which project into respective recesses 67 in each locking lugs 22. Each recess has a cam following surface 68, and as the slide moves forwardly on the bolt body, the ramp surface 66 engages the surface 68 to cam the locking lug outwardly, while concurrently the cut out 64 clears the stud 62.

A stud 70 is integral with the body of the gun bolt and has a cross bar having two ends 72 which overlie an upwardly facing surface 74 of the slide. These overlying ends preclude any possible upward movement of the slide which might otherwise tend to permit disengagement of the studs 62 from the arcuate slots 64.

While the invention has been shown embodied in a Gatling type gun, it will be obvious that it has application to single barrel guns wherein the gun bolt is driven by a rotating drum cam, such as is shown in U.S. Pat. No. 1,786,207 issued to R. F. Hudson on Dec. 23, 1930. In such case the two cam tracks 36 and 42 will be formed on the drum cam, rather than on the housing, and the gun bolt assembly will reciprocate in the receiver. In either case relative motion is provided between the cam tracks and the gun bolt assembly.

We claim:

1. A gun including:

a receiver [18];

a gun bolt assembly journaled for reciprocation along a longitudinal axis in said receiver;

a first transverse cam track [36];

a second transverse cam track [42];

means for providing relative transverse motion between said gun bolt assembly and said first and second cam tracks;

a locking lug [22] pivotally mounted to said receiver [18] and having a first cam following surface [51] and a second cam following surface [68];

said gun bolt assembly including:

a gun bolt body [10] having a cam surface [50];

a face [56] for transmitting force along a longitudinal component;

a first cam follower [34] engaged with said first cam track [36], having a mode of operation such that relative transverse motion between said first cam track and said first cam follower provides reciprocation of said gun bolt body [10] relative to said receiver [18];

a slide [12] carried by and journaled for relative longitudinal reciprocation with respect to said gun bolt body [10] and having:

a cam surface [66];

a second cam follower [40] engaged with said second cam track 1 [42], having a mode of operation such that relative motion between said second cam track and said second cam follower provides reciprocation of said slide [12] relative to said gun bolt body [10];

an actuator lug [44] pivotally mounted to said slide [12], having a mode of operation such that reciprocation of said slide progressively in a first direction [aft] relative to said body causes said actuator lug to be cammed progressively outwardly by such cam surface [50] of said gun bolt body and to engage said first cam following surface [51] of said locking lug [22] to pivot said locking lug progressively in a first direction to engage said gun bolt body to lock said gun bolt body against reciprocation in a first direction [aft], and that reciprocation of said slide in a second direction [forward] relative to said body causes said cam surface [66] of said slider to engage said second cam following surface [68] of said locking lug [22] to pivot said locking lug progressively in a second direction to disengage from said gun bolt body to unlock said gun bolt body to permit reciprocation in said first direction.

2. A gun according to claim 1 wherein:

said locking lug [22] further includes first interlocking means [62], and said slide further includes second interlocking means [64];

having a mode of operation such that said progressive reciprocation of said slide [12] in its said first direction and said progressive pivoting of said locking lug [22] in its said first direction causes the progressive mutual interlocking of said first interlocking means and said second interlocking means whereby when said slide has completed its travel in its said first direction said locking lug is locked against pivotal movement.

3. A gun according to claim 2 wherein:

the group consisting of said first interlocking means [62] and said second interlocking means [64] includes a projection on one member of said group and a recess on the other member of said group.

4. A gun according to claim 2 wherein:

said first interlocking means [62] comprises an upstanding stud and said second interlocking means [64] comprises an arcuate recessed track.

5. A gun according to claim 2 wherein:

said gun bolt assembly cam surface is one of a symmetrical pair of cam surfaces;

said slide cam surface and actuator lug are each one of a symmetrical pair of cam surfaces and actuator lugs; and said receiver locking lug is one of a symmetrical pair of locking lugs.

6. A gun according to claim 5 wherein:

said receiver is a rotor in a Gatling type gun and said gun bolt assembly is one of a plurality of such assemblies disposed in said rotor.

7. A gun according to claim 6 wherein:

said gun further includes a housing in which said rotor is journaled for rotation, and said first transverse cam track and said second transverse cam track are disposed in said housing.

8. A gun according to claim 7 wherein:

said gun bolt body and said slide include mutual means for precluding relative transverse movement of said bolt body and said slide.

9. A gun according to claim 1 wherein:

said gun bolt assembly cam surface is one of a symmetrical pair of cam surfaces;

said slide cam surface and actuator lug are each one of a symmetrical pair of cam surfaces and actuator lugs; and said receiver locking lug is one of a symmetrical pair of locking lugs.

10. A gun according to claim 9 wherein:

said receiver is a rotor in a Gatling type gun and said gun bolt assembly is one of a plurality of such assemblies disposed in said rotor.

11. A gun according to claim 10 wherein:

said gun further includes a housing in which said rotor is journaled for rotation, and said first transverse cam track and said second transverse cam track are disposed in said housing.

12. A gun according to claim 11 wherein:

said gun bolt body and said slide include mutual means for precluding relative transverse movement of said bolt body and said slide.

* * * * *